US006206793B1

(12) United States Patent
Burger

(10) Patent No.: US 6,206,793 B1
(45) Date of Patent: Mar. 27, 2001

(54) COMPOSITE HOCKEY STICK HANDLE WITH RESILIENT SHROUD

(75) Inventor: George W. Burger, Rocklin, CA (US)

(73) Assignee: Hillerich & Bradsby Co., Louisville, KY (US)

( * ) Notice: Subject to any disclaimer, the term of this patent is extended or adjusted under 35 U.S.C. 154(b) by 0 days.

(21) Appl. No.: 08/997,344

(22) Filed: Dec. 23, 1997

(51) Int. Cl.[7] ..... A63B 59/12
(52) U.S. Cl. ..... 473/561
(58) Field of Search ..... 473/560–563, 473/FOR 189, 535, 536

(56) References Cited

U.S. PATENT DOCUMENTS

| | | | |
|---|---|---|---|
| 2,201,706 | 5/1940 | Sukohl . | |
| 2,649,133 | 8/1953 | Just . | |
| 2,674,557 | 4/1954 | Boggs . | |
| 2,964,065 | 12/1960 | Haroldson et al. . | |
| 3,020,192 | 2/1962 | Stephens et al. . | |
| 3,125,478 | 3/1964 | Pratt . | |
| 3,606,326 | 9/1971 | Sparks . | |
| 4,016,640 | 4/1977 | Briggs . | |
| 4,080,879 | 3/1978 | Hoden et al. . | |
| 4,134,198 | 1/1979 | Briggs . | |
| 4,212,461 * | 7/1980 | Cecka et al. | 473/535 |
| 4,273,601 | 6/1981 | Weingart . | |
| 4,579,617 | 4/1986 | Öberg et al. . | |
| 4,591,155 * | 5/1986 | Adachi | 473/561 |
| 4,923,541 | 5/1990 | Burger . | |
| 5,005,254 | 4/1991 | Uffindell . | |
| 5,024,712 | 6/1991 | Lecourt et al. . | |
| 5,050,289 | 9/1991 | Uffindell . | |
| 5,217,221 | 6/1993 | Baum . | |
| 5,373,616 | 12/1994 | Biersdorf et al. . | |
| 5,419,553 | 5/1995 | Rodgors . | |
| 5,439,215 | 8/1995 | Ratchford . | |
| 5,458,330 | 10/1995 | Baum . | |
| 5,655,981 | 8/1997 | Reed . | |

FOREIGN PATENT DOCUMENTS

| | | | | |
|---|---|---|---|---|
| 557838 * | 5/1958 | (CA) | 473/FOR 189 |
| 637779 * | 5/1950 | (GB) | 473/FOR 189 |

* cited by examiner

*Primary Examiner*—Mark S. Graham
(74) *Attorney, Agent, or Firm*—Bernhard Kreten

(57) ABSTRACT

A hand-held implement grip and protectant, preferably for a hockey stick, is described. The invention mainly consists of a blade attached to a composite shaft integrally enshrouded with a rubber sheath. A method of forming the same is also provided as laying up a number of sheets of composite material, wrapping those sheets about a mandril, enshrouding the layup with a rubber sheath, vulcanizing the combination, removing the mandril, and inserting a blade therein.

8 Claims, 5 Drawing Sheets

COMPOSITE HOCKEY STICK HANDLE WITH RESILIENT SHROUD

FIELD OF THE INVENTION

This invention relates to hand-held implements, especially sports equipment, such as hockey sticks. More specifically, the instant invention is directed to a hockey stick handle formed from composite material having an integrally formed outer elastomeric shroud to protect the composite material and improve gripping ability.

BACKGROUND OF THE INVENTION

The necessity for adequately gripping hand-held implements has been a long-known and recurring problem. A variety of grips have been explored, but problems still persist. Although it is known to include a rubberized grip about the handle of an implement, certain drawbacks still exist.

One problem encountered with prior art gripping means (such as U.S. Pat. Nos. 5,050,289 and 5,005,254) is the slippage of the grip vis-à-vis a handle. Whether a grip is glued to a handle or friction-fitted, such rubberized grips have a tendency to dislodge from a shaft. Furthermore, the longer the shaft, and the longer the grip vis-à-vis the shaft, the greater the likelihood of the grip rolling up on itself or slipping. Many attempts have been made to correct this problem, but to no avail. Ultimately, the hand-held implement is either replaced, or the grip is replaced, wasting much time and material.

Another problem involves the now frequent use of hockey stick shafts formed from composite material. "Space-age" materials, such as Kevlar®, boron and graphite, while extremely strong in compression, tension and flexing, have been found to be susceptible to fracture when sharply impacted, such as by a hockey puck or another hockey stick.

It is desirable therefore to provide a hand-held implement with a resilient grip capable of extending a greater distance along the hockey stick shaft, and providing a grip that endures greater impacts and pressures without fracture or slippage.

One particular application where a shock damping is desirable along an entire shaft and where a grip is required to adhere strongly is that of a hockey stick. Currently, hockey stick grips tend to be just near the top of a shaft and are of a short length. If extended further down the shaft, or preferably all the way down the shaft, the grip tends to slip, roll or bunch in the prior art. To overcome these problems would be a great benefit to the sport and overall safety.

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| INVENTOR | ISSUE DATE | PATENT NO. |
|---|---|---|
| 2,201,706 | Sukohl | 05-21-1940 |
| 2,649,133 | Just | 08-18-1953 |
| 2,674,557 | Boggs | 04-06-1954 |
| 2,964,065 | Haroldson, et al. | 12-13-1960 |
| 3,020,192 | Stephens, et al. | 02-06-1962 |
| 3,125,478 | Pratt | 03-17-1964 |
| 3,606,326 | Sparks | 09-20-1971 |
| 4,016,640 | Briggs | 04-12-1977 |
| 4,080,879 | Hoden, et al. | 03-28-1978 |
| 4,134,198 | Briggs | 01-16-1979 |
| 4,273,601 | Weingart | 06-16-1981 |
| 4,579,617 | Oberg, et al. | 04-01-1986 |
| 4,923,541 | Burger | 05-08-1990 |
| 5,005,254 | Uffindell | 04-09-1991 |
| 5,024,712 | Lecourt, et al. | 06-18-1991 |
| 5,050,289 | Uffindell | 09-24-1991 |
| 5,373,616 | Biersdorf, et al. | 12-20-1994 |
| 5,458,330 | Baum | 10-17-1995 |
| 5,655,981 | Reed | 08-12-1997 |

The prior art listed above, but not specifically discussed, teach gripping devices and further catalog the prior art of which the applicant is aware. These references diverge even more starkly from the references specifically distinguished above.

SUMMARY OF THE INVENTION

This invention is directed toward addressing the problems of providing an anti-fracture gripping means to an elongate member, such as a hockey stick shaft, wherein that gripping means will protect the underlying composite and still will be substantially free from unwanted vibration, slipping, bunching, or rolling up on itself vis-à-vis the shaft. To overcome these problems, this invention provides a means for integrally forming a grip to a shaft. This integral formation is accomplished, essentially, by forming the grip and shaft composite as an integrated unit and ultimately heating the shaft and grip combination at a desired temperature to integrate both the shaft and grip into one.

The most common shaft types (wood, metal, plastic) will not optimally accept heating to combine with a grip. This invention provides, in particular, for resin pre-impregnated into fiber, such as graphite impregnated with epoxy, to be heated and cured together with the grip and the invention also alternatively provides for a similar integration with thermoplastic.

By first wrapping epoxy-impregnated uncured graphite about a heat conductive mandril to form a shaft, a heat susceptible medium is provided. By next placing the mandril and shaft combination into a vacuum tube lined with the grip on the tube interior by evacuating the tube to conform the grip to the tube, the graphite shaft receives the grip by releasing the vacuum and next providing some pressure on the now grip-lined shaft. Thereafter, by heating the shaft and rubber sheath combination at an appropriate temperature for an appropriate amount of time, the integration of the shaft and sheath is accomplished by vulcanization. All then that remains is the removal of the mandril from the core of the shaft to provide an elongate hollow shaft integrated with a grip. With this grip provided over the entire shaft or substantially all of the shaft, it is also far less susceptible to damage versus the prior art.

In particular, in a hockey stick, the hockey stick handle is also to be provided with a rubberized cuff at one end to receive a blade thereafter in a hollow of the shaft. Prior to this invention, such a shaft/grip combination was not provided in the hockey sports industry.

OBJECTS OF THE INVENTION

The overall object of the present invention is to provide a handle and grip means which are integrally formed for a long-handled or shafted device, particularly a hockey stick.

It is a specific object of the present invention to provide a grip means on an elongate shaft that is not susceptible to slipping and delamination vis-à-vis the shaft.

It is another object of the present invention to provide a grip means on an elongate shaft that is not susceptible to rolling or bunching on the elongate shaft.

It is another object of the present invention to provide an elongate shaft, such as a graphite impregnated epoxy-type shaft cooked and cured with a rubber sheath for gripping about the entirety of the shaft to protect the graphite.

It is another object of the present invention to provide a method of manufacturing an elongated shaft having a grip means provided about its entirety and integrated therewith to cushion sharp blows to the shaft.

Viewed from a first vantage point, it is an object of the present invention to provide a hockey stick, comprising, in combination, a shaft, a blade attached to the shaft, the shaft formed from a composite layup including a hollow core, and a sheath formed from resilient material ensconcing the shaft.

Viewed from a second vantage point, it is an object of the present invention to provide a method for forming a hockey stick, the steps including, laying up a composite material, forming the layup of composite material about a mandril defining a layup wrapped mandril, ensconcing a resilient sheath over the layup wrapped mandril, vulcanizing the sheath and layup wrapped mandril combination, removing the mandril, and inserting a hockey blade hosel in a central core of the layup formed by removal of the mandril.

Viewed from a third vantage point, it is an object of the present invention to provide a hockey stick, comprising, in combination, a shaft, and a blade attached to the shaft, the shaft formed by laying up a plurality of uncured resin-impregnated sheets of composite material, forming the plurality of sheets about a mandril, defining a layup wrapped mandril, ensconcing a resilient sheath over the layup wrapped mandril, vulcanizing the sheath and layup wrapped mandril combination, and removing the mandril.

Viewed from a fourth vantage point, it is an object of the present invention to provide a shaft for a hockey stick, comprising, in combination, a composite layup including a hollow core, and a sheath formed from resilient material ensconcing the shaft.

These and other objects will be made manifest when considering the following detailed specification when taken in conjunction with the appended drawing figures.

DESCRIPTION OF PREFERRED EMBODIMENTS

Figure 1:
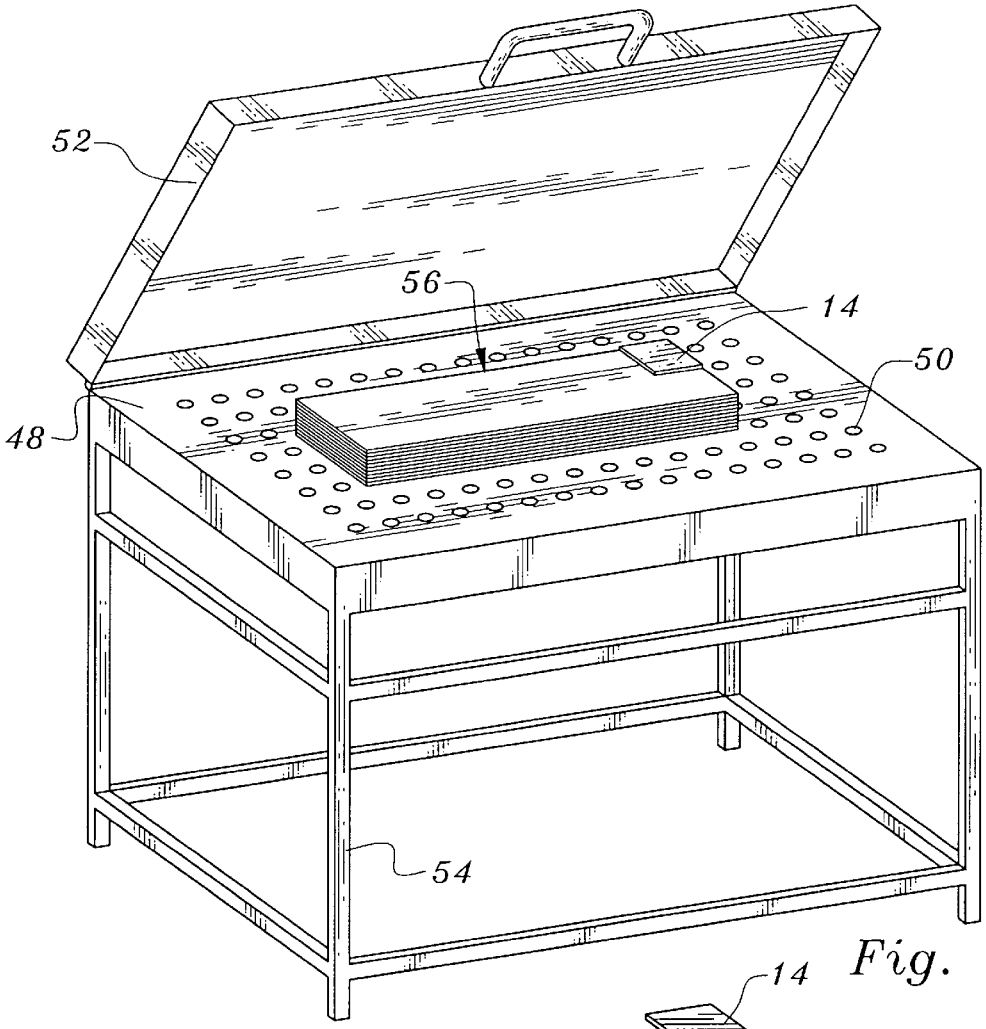
FIG. 1 is a perspective view of composite layers on a vacuum table.
Figure 1A:
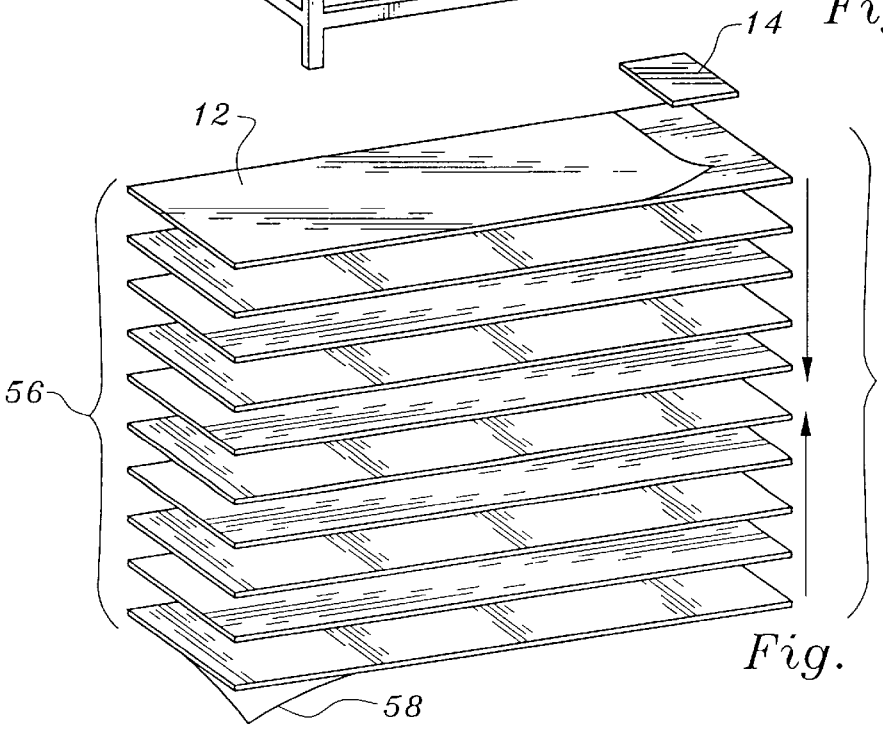
FIG. 1A is an exploded perspective view of the composite layers shown in FIG. 1.

Considering the drawings, wherein like reference numerals denote like parts throughout the various drawing figures, reference numeral 10 (FIG. 7) is directed to a hockey stick integrally formed with a shaft and gripping means thereabout according to the present invention.

The grippable shaft 10 is formed of three main components: layers of a thermoset synthetic material 12; an elastic sheath 30; and a hockey blade B having a hosel 13.

Figure 4:
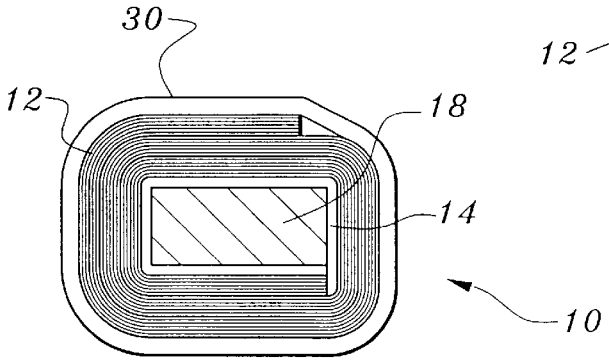
FIG. 4 is a front cross-sectional view of that which is shown in FIG. 3C.
Figure 7:
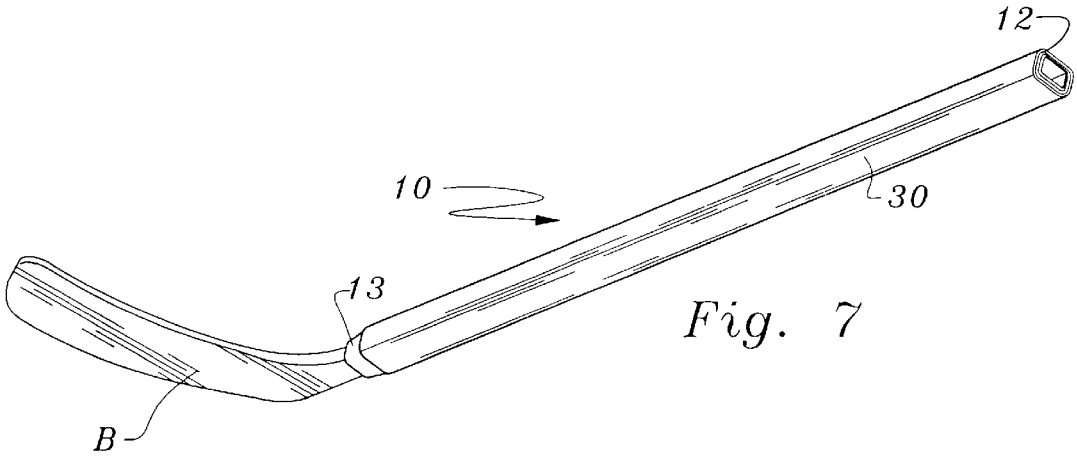
FIG. 7 is a perspective view of the invention.

As seen in FIGS. 4 and 7, a grippable sheath 30 is integrally formed with a plurality of fabric layers 12 wherein the fabric layers 12 are preferably pre-impregnated graphite epoxy and wherein the sheath 30 is preferably then a rubber tube. Whereas the sheath 30 becomes integrally formed with the fabric layers 12 and the elastic cuff 14 by means of a heating and curing process. The elastic cuff is preferably made of urethane.

In manufacture, as first depicted in FIG. 1, as a first step, adhesive transfer sheets are removed from sheets 12 to expose the resin thereunder to other sheets 12, save for the uppermost and lowermost sheets 12, where transfer sheets 58 remain temporarily. Next, urethane strip 14 is added atop the stack and the entire layup 56 is placed within vacuum table 48 supported by legs 54. When lid 52 is closed, a vacuum is produced via vacuum holes 50, causing sheets 12 and strip 14 to be pressed together (had uppermost and lowermost transfer sheets 58 not remained, adherence to the lid 52 and/or table 48 would likely result). The size of urethane strip 14 is preferably less than both the length and width of fabric layers 12. More preferably, strip 14's length L is as long as the circumference of mandril 18.

Figure 2B:
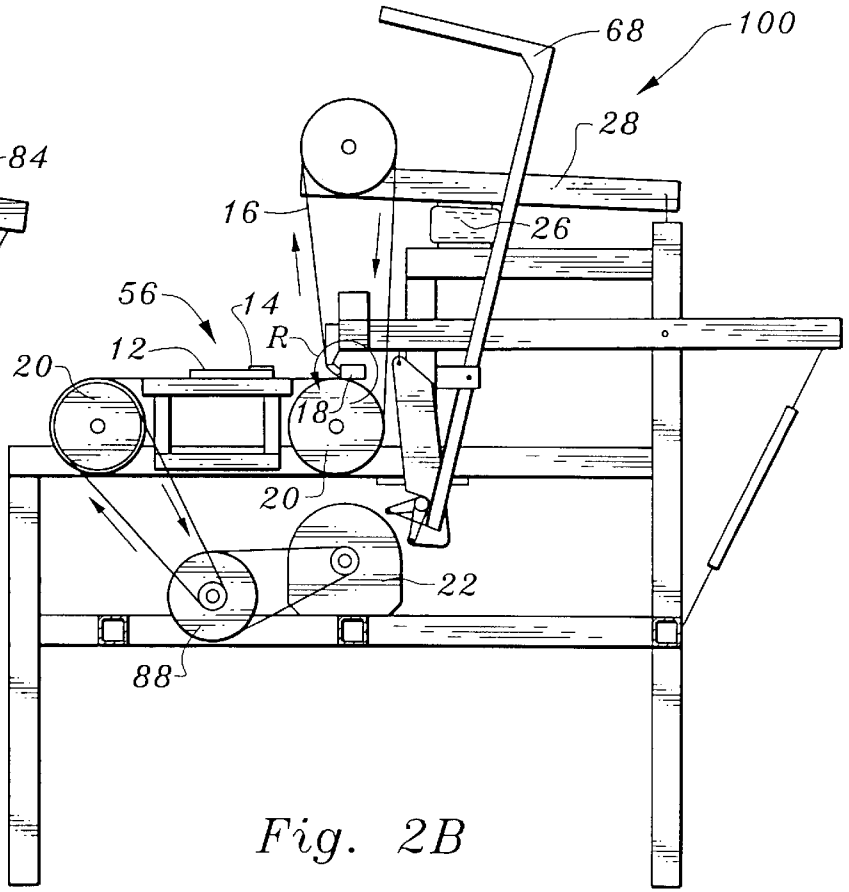
FIG. 2B is a side view of a device for wrapping layup about a mandril in an closed operational position.
Figure 2A:
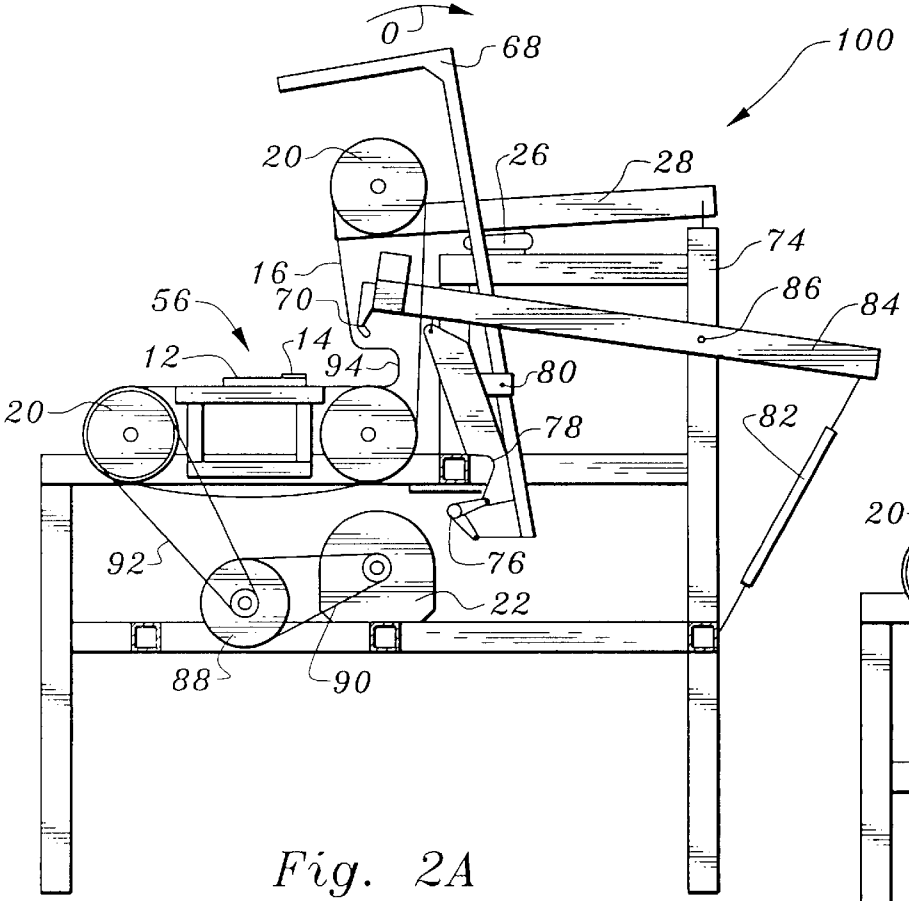
FIG. 2A is a side view of a device for wrapping layup about a mandril in an open position.

Next, as depicted in FIGS. 2A and 2B, the shaft 10 is formed by first providing multiple epoxy-impregnated graphite sheets 12, having the remaining transfer sheets 58 now removed, and a urethane or rubber elastomer 14 thereby which are then wrapped about a mandril 18. The sheets 12 are preferably the graphite type wherein the grains of graphite can be a mixture of longitudinal, latitudinal or crossed grains. That is, each individual graphite sheet 12 may have the same or different grain varieties included. One, for instance, may have graphite strands all longitudinally drawn. Another sheet 12 may have all the graphite grains perpendicular to the previous sheet 12. Yet another sheet or sheets may have the grains of graphite running at various angles. By utilizing different grain striations on sheets 12, different shaft strength characteristics can be achieved. By providing a strip of elastomer such as urethane 14 immediately next to sheets 12, the elastic receptacle or cuff 14 can later be formed.

As the strips 12 and elastomer 14, known as layup 56, progress down the conveyer belt 16 as depicted in FIG. 2B, they are wrapped around and adhered to a heat conductive mandril 18. Conveyor belt 16 is rotated by motor 22 coupled to pulleys or rollers 20. Likewise, belt 16, also driven by motor 22 when tightened by moving lever 68 along arrow O and activating tension means 26 and thereby raising arm 28, will thereby rotate mandril 18 around arcuate arrow R and wrap layup 56 about it in turn. Mandril 18 with sheets 12 and urethane 14 wrapped about it is then removed.

As relates more particularly to mandril wrapping machine 100, the device is made up of the following. As shown in FIG. 2A, when lever 68 is in a resting (or open) position, belt 16 is loosely wrapped about rollers 20. Motor 22, coupled to motor wheel 88 by belt 90, will cause belt 90 to turn motor wheel 88, thereby causing belt 92 to likewise rotate wheels 20 via belt 16. Thereafter, when lever 68 is moved in the direction of arrow O about pivot 80, resulting in the FIG. 2B, tension means of pump 26 causes arm 28 to raise and tension the upper roller 20, thereby tensioning conveyor belt 16 about the plurality of rollers 20. That tensioning causes the belt 16 to tightly wrap around a mandril 18. In particular, when lever 68 is moved along arrow O, the V-shaped coupling 76 likewise rotates into arcuate notch 78, locking the device into a closed position and tensioning tension support 82 coupled to arm 84 when arm 84 likewise pivots about pivot point 86. When tightly tensioned as indicated above, mandril 18 will be caused to rotate around arcuate arrow R by belt 16 next to bight 94 as contained by hooked stop 70. As the layup 56 is conveyed along belt 16 to mandril 18, layup 56 will likewise be tightly wrapped about mandril 18 and held in place by hooked stop 70 at the end of guide arm 84. After, to remove the layup wrapped mandril from apparatus 100, lever 68 is moved in the opposite direction of arrow O to unlock the device 100 so that the layup wrapped mandril may be removed therefrom. A supporting frame 74 provides a rigid structure for the above-described apparatus.

Figure 3A:
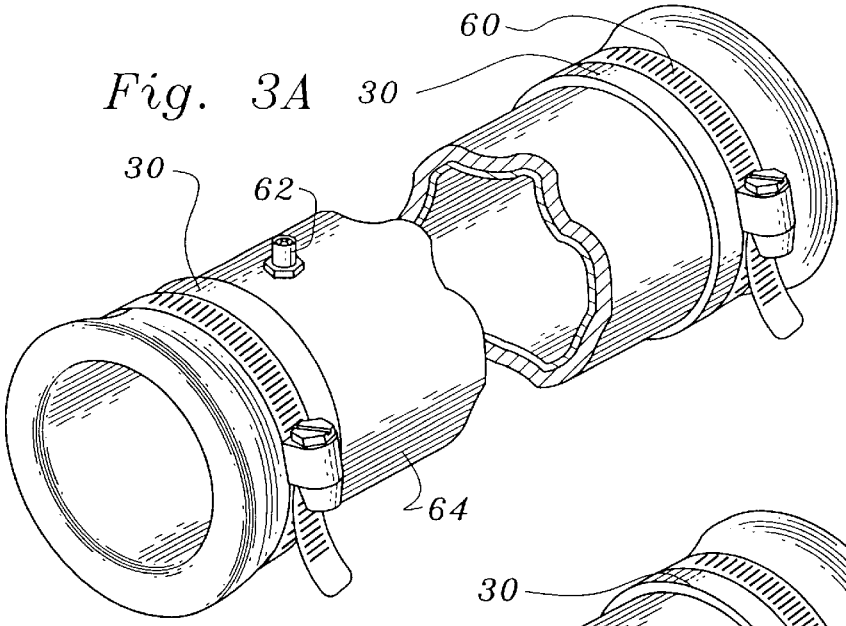
FIG. 3A is a cutaway perspective view of a vacuum pipe and rubber sheath.
Figure 3B:
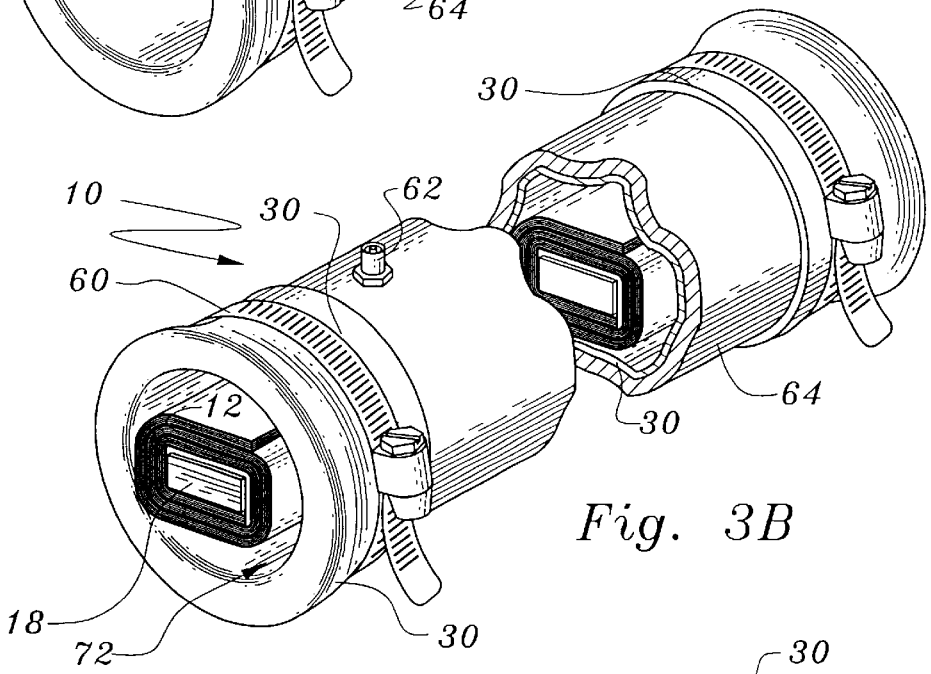
FIG. 3B is the cutaway view of FIG. 3A with a layup wrapped mandril therein.
Figure 3C:
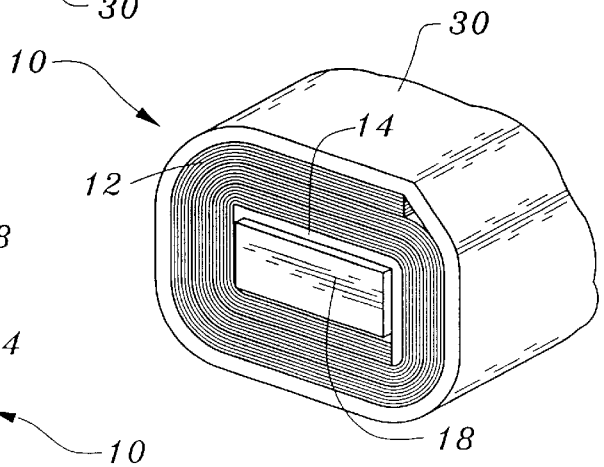
FIG. 3C is a perspective end view of a layup wrapped mandril enshrouded with elastomer.

Thereafter, as shown in FIGS. 3A and 3B, the mandril 18 wrapped with sheets 12 is inserted into an air pressurized sheath 30, which is clamped about a pipe 64 at both ends to cause cavity 72 to be formed. As can be seen in FIGS. 3A and 3B, sheath 30 is longer than pipe 64, and once inserted into pipe 64, the ends of sheath 30 are wrapped back onto the outside of pipe 64 to be clamped by clamp means 60. Pipe 64, therefore, has an inside diameter greater than the mandril 18 and layup 56 combination. The cross-section of pipe 64 can be circular as depicted or any other shape as necessary. The sheath 30 is expanded via an air pressure means 62, or evacuated, to so accommodate the mandril-wrapped shaft. Then the vacuum between sheath 30 and sheets 12 and mandril 18 is released from valve 62, so that sheath 30 conforms completely about the mandril-wrapped sheets 12 as shown in FIGS. 3C and 4. At this point, the grippable sheath 30 is frictionally affixed to sheets 12 which are wrapped about mandril 18.

Figure 5:
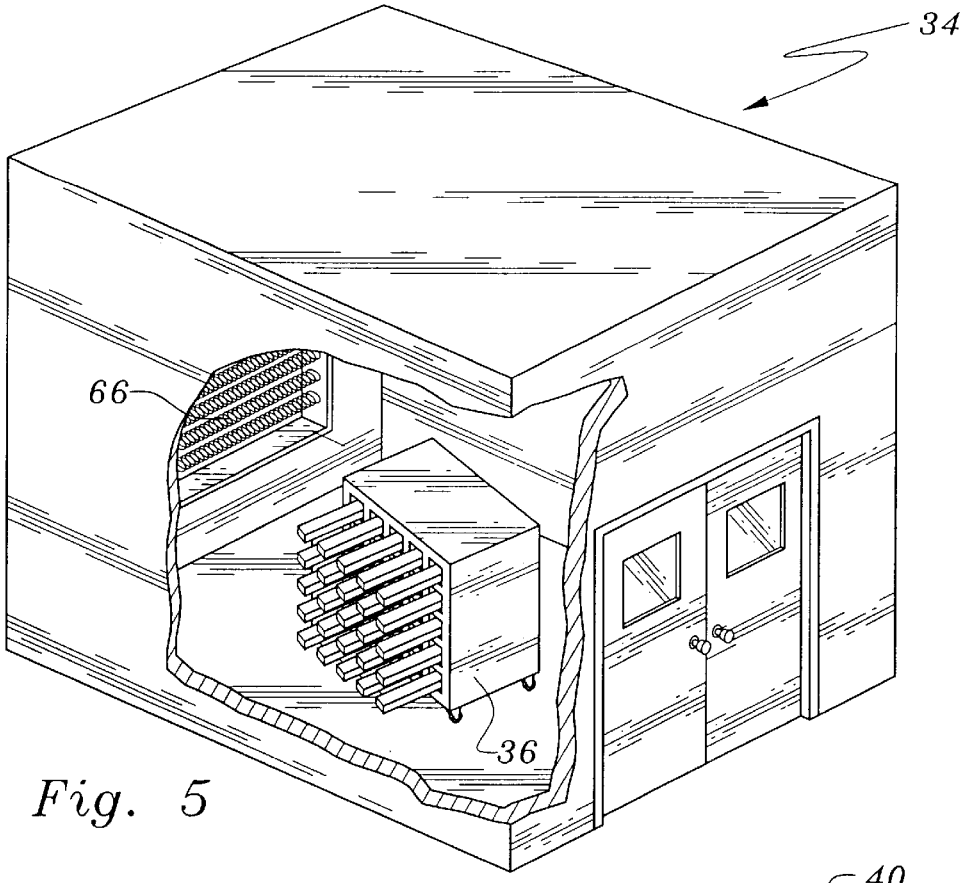
FIG. 5 is a cutaway perspective of a heating chamber.

To further integrate sheath 30 with sheets 12, the combination must be allowed to be heated and cured, or vulcanized, as the process is known, as depicted in FIG. 5 in heating chamber 34. FIG. 5 shows a rack 36 of a plurality of the inventions with an inner mandril core 18 wrapped with sheets 12 encased in sheath 30 having an elastic receptacle 14 combined therewith, ready for heating by element 66. Once heated to the desired temperature and cooked for the desired period of time, racks 36 are removed from oven 34 where the shafts have been vulcanized. They are thereafter allowed to cure. For thermoplastics, heating at 350° F. to 550° F. (176° C. to 288° C.) for thirty seconds to ten minutes with a subsequent dwell or hold time to allow bubbles and gases to escape, is preferred. It may be beneficial to heat the thermoplastic prior to applying the rubber sheath 30. For epoxies, heating at 150° F. to 350° F. (65° C. to 177° C.) for one to two hours is preferred.

Figure 6:
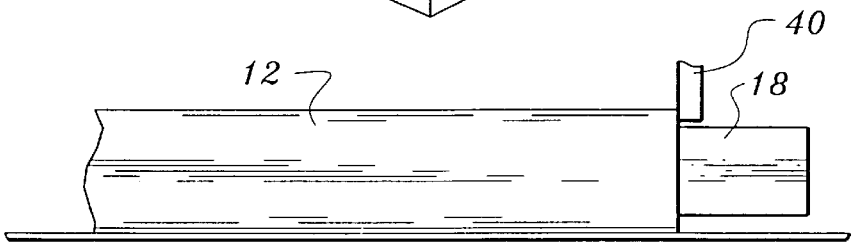
FIG. 6 is a side view of a mandril being removed from the invention.
Figure 8:
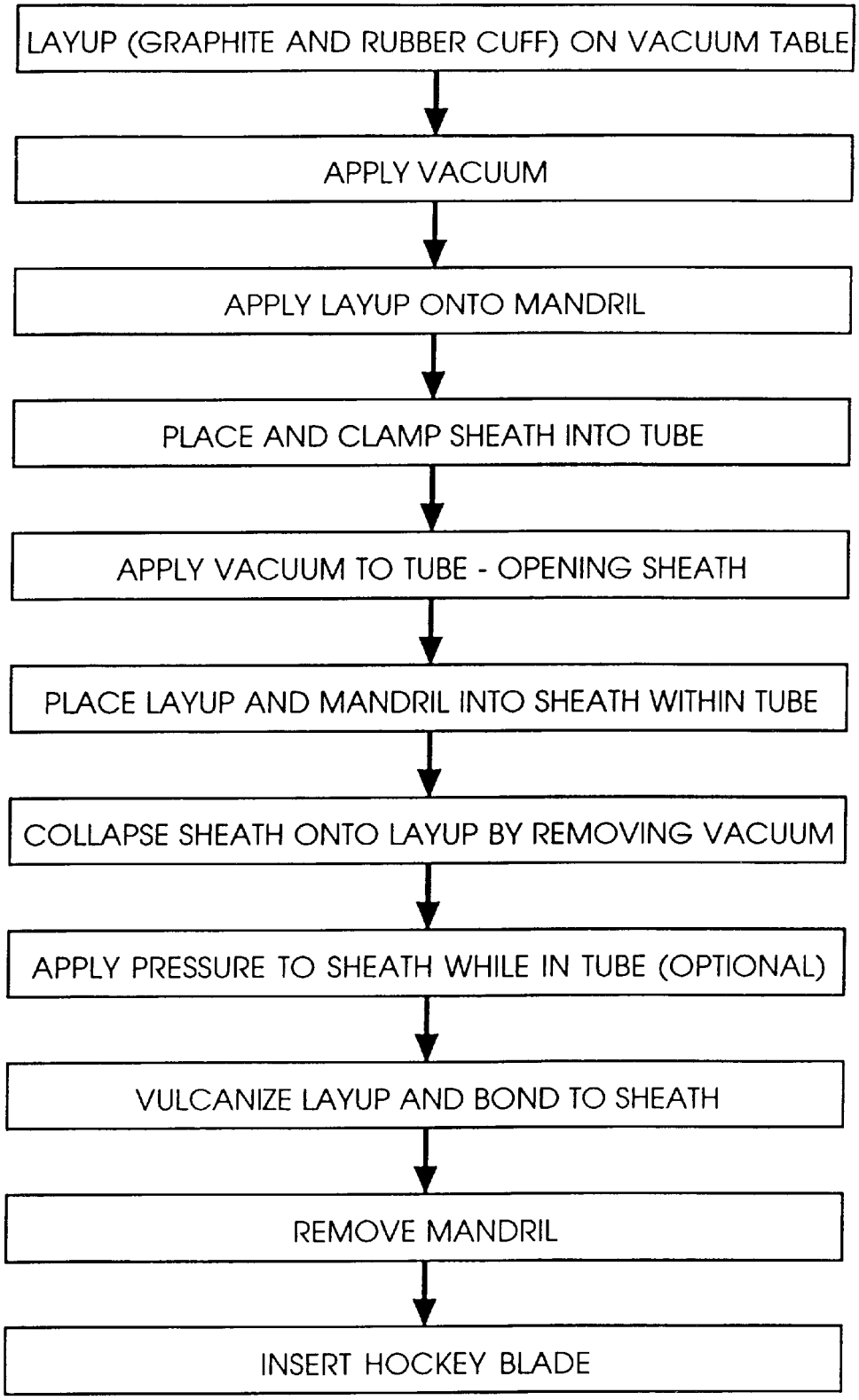
FIG. 8 is a flowchart of the method of the invention.

Once cured and cooled, the mandril 18 can be removed from within the core of the sheets 12 by sliding the shaft to a stop 40 and pushing or pulling mandril 18 out from within as depicted in FIG. 6. Thereafter, one has a grip ensconced shaft as depicted in FIG. 7 which may be mated, preferably with a blade B, by inserting blade B's hosel portion 13 into receptacle or cuff 14 to form a hockey stick 10. The entirety of this process is depicted in a flowchart at FIG. 8. In one form, the sheath 30 ensconces the entirety of the shaft, In another, the sheath 30 initially ensconces the entirety of the shaft, but later, a few inches are melted off during the blade mating process.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A hockey stick, comprising, in combination:

a shaft;

a blade attached to said shaft;

said shaft formed from a composite layup including a hollow core; and a sheath formed from resilient material ensconcing said shaft;

wherein said composite layup is comprised of a plurality of graphite sheets;

wherein said graphite sheets are impregnated with resin, and affixed to each other by said resin;

wherein said resilient material runs the length of said shaft;

wherein said resilient material is rubber;

wherein said layup further comprises a urethane sheet; and wherein said urethane sheet defines an innermost layer of said shaft.

2. A shaft for a hockey stick, comprising, in combination:

a composite layup including a hollow core; and a sheath formed from resilient material ensconcing said shaft;

wherein said resilient sheath runs the length of the shaft;

wherein said resilient sheath is rubber;

wherein said composite layup is comprised of a plurality of graphite sheets;

wherein said graphite sheets are impregnated with resin and affixed to each other by said resin;

wherein said layup further comprises a urethane sheet;

wherein said urethane sheet defines an innermost layer of the shaft.

3. A shaft for a hockey stick, comprising, in combination:

a composite layup including a hollow core; and a sheath formed from resilient material ensconcing said shaft;

wherein said resilient sheath runs the length of the shaft;

wherein said resilient sheath is rubber;

wherein said composite layup is comprised of thermoplastic materials;

wherein said layup further comprises a urethane sheet;

wherein said urethane sheet defines an innermost layer of the shaft.

4. A hockey stick, comprising, in combination:

a shaft;

a blade attached to said shaft;

said shaft formed from a composite layup including a hollow core; and a sheath formed from resilient material ensconcing said shaft;

wherein said layup further comprises a urethane sheet;

wherein said urethane sheet defines an innermost layer of said shaft.

5. The hockey stick of claim 4 wherein said blade includes a hosel coupled into said shaft hollow core, said urethane layer overlying said hosel.

6. The hockey stick of claim 5 wherein said urethane sheet has a lesser length than said shaft.

7. A shaft for a hockey stick, comprising, in combination:

a composite layup including a hollow core; and a sheath formed from resilient material ensconcing said shaft;

wherein said layup further comprises a urethane sheet;

wherein said urethane sheet defines an innermost layer of the shaft.

8. A shaft for a hockey stick, comprising, in combination:

a composite layup including a hollow core; and a sheath formed from resilient material ensconcing said shaft;

wherein said composite layup is comprised of thermoplastic materials;

wherein said layup further comprises a urethane sheet;

wherein said urethane sheet defines an innermost layer of the shaft.

* * * * *